US005749528A

United States Patent [19]

Carey et al.

[11] Patent Number: 5,749,528

[45] Date of Patent: May 12, 1998

[54] REVERSIBLE SPRAY TIP

[75] Inventors: Danuta H. Carey, Stockholm; John D. Geberth, Ramsey; John Walsh, Madison; Daniel S. Hosley, Clinton, all of N.J.

[73] Assignee: Titan Tool, Inc., Oakland, N.J.

[21] Appl. No.: 578,864

[22] Filed: Dec. 27, 1995

[51] Int. Cl.[6] ..... B05B 1/28; B05B 15/02

[52] U.S. Cl. ..... 239/119; 239/288

[58] Field of Search ..... 277/34, 34.3, 213; 239/119, 288, 288.3

[56] References Cited

U.S. PATENT DOCUMENTS

| | | | |
|---|---|---|---|
| 3,202,360 | 8/1965 | O'Brien | 239/119 |
| 3,428,340 | 2/1969 | Pelton | 277/213 |
| 4,165,836 | 8/1979 | Eull | 239/119 |
| 4,508,268 | 4/1985 | Geberth, Jr. | 239/119 |
| 4,611,758 | 9/1986 | Geberth, Jr. | 239/119 |
| 4,715,537 | 12/1987 | Calder | 239/119 |
| 4,738,401 | 4/1988 | Filicicchia | 239/600 |
| 4,757,947 | 7/1988 | Calder | 239/119 |
| 5,280,853 | 1/1994 | Perret, Jr. | 239/119 |
| 5,294,053 | 3/1994 | Perret, Jr. | 239/119 |
| 5,340,029 | 8/1994 | Adams | 239/119 |
| 5,454,515 | 10/1995 | Perret | 239/119 |

*Primary Examiner*—Andres Kashnikow
*Assistant Examiner*—Robin O. Evans
*Attorney, Agent, or Firm*—Bucknam and Archer

[57] ABSTRACT

There is provided a reversible spray tip or nozzle used with a spray gun or like device for hydraulically atomizing and spraying liquids such as paint. The spray tip includes a plastic housing having a forward extending spray tip guard integral therewith, a cylindrically shaped rotatable turret member diametrically received for rotation in the housing and having a diametric bore therethrough for receipt of a spray tip insert, and an elongated seal insert axially received in the housing upstream from the turret member. A securing nut rotatably mounted to the housing at the spray gun end thereof secures the reversible spray tip to the discharge end of the spray gun. The enhanced sealing effectiveness of the reversible spray tip permits effective sealing of the assembly by finger tightening of the securing nut.

27 Claims, 6 Drawing Sheets

REVERSIBLE SPRAY TIP

The present invention relates generally to spray tips or nozzles for use in spray guns which are adapted to hydraulically atomize and spray liquids such as paint and, more particularly, it relates to such spray tips or nozzles wherein the spray tip is reversible so that obstructions therein which clog the nozzle may be easily removed by the reversed flow of the high pressure liquid therethrough.

An inherent disadvantage in hydraulic or airless spray painting, wherein paint under high pressure is supplied to a spray gun and forced through a spray tip or nozzle, is clogging. Because of the nature of this method of paint spraying, it is necessary that the spray opening in the spray tip be very small so that as the paint reaches the spray tip under high pressure and low velocity, it is accelerated through the spray opening to a high velocity and low pressure thereby forming a fan spray suitable for painting. Because of the small size of the spray opening, the spray is susceptible to clogging with particles carried in the fluid paint.

One simple method of unclogging hydraulic spray tips is to provide a spray tip which is reversible so that the flow therethrough can be reversed to thereby dislodge the particles causing the clog. Examples of hydraulic spray tips incorporating such reversibility can be found in U.S. Pat. No. 4,508,268, to Geberth, Jr., granted Apr. 2, 1985; U.S. Pat. No. 3,202,360, to O'Brien, granted Aug. 24, 1965; U. S. Pat. No. 4,165,836, to Eull, granted Aug. 28, 1979; and U. S. Pat. No. 4,715,537, to Calder, granted Dec. 29, 1987. In each of these prior art patents, the spray tip is mounted in a diametric bore in a transverse cylinder which is adapted for axial rotation so as to present the spray tip forwardly for spraying or rearwardly so that the spray tip faces the high pressure liquid. In this latter position, the high pressure liquid passing through the spray tip in the reversed direction dislodges and removes any clogging matter therein. The transverse, axially rotatable cylinder is supported in a transverse bore of a housing therefor which has a flange at its end facing the discharge end of the spray gun, which flange is engaged by a securing nut which secures the assembly to the forward end of the spray gun. Appropriately sealing members are also provided to prevent leakage during operation of the spray tip.

A major problem inherent in such reversible spray tips is preventing leakage between the axially rotatable cylindrical member and the fluid bore passing through the housing delivering the high pressure fluid paint to the spray opening of the spray tip. The usual construction of such reversible spray tips includes an insert axially arranged in an axial bore of the housing and which is provided with a fluid bore passing therethrough. This insert performs the sealing function and is formed of a generally soft material such as plastic with a flange at the end facing the spray gun which is compressed between the flange of the housing and the discharge end of the spray gun The end of the insert facing the rotatable cylinder may be formed of plastic material as in the U. S. Pat. No. 4,508,268 or it may be provided with a hard material at this face in order to prevent scoring of the material at this face as disclosed in U.S. Pat. No. 4,611,758, to Geberth, Jr., granted Sep. 16, 1986. In either event, sealing pressure is provided by the securing nut which must be tightened significantly.

In addition, the patent to Eull shows and describes a spray tip guard of common V-shape having a receptacle at its apex which receives therein the transverse rotatable cylindrical member and housing therefor. This assembly is held together by securing means which secures the cylindrical member and housing in the receptacle of the tip guard so that upon removal of the securing means, the integrity of the assembly collapses. The object of this construction is to prevent operation of the spray gun without the spray guard being attached which may result in accidental injection of the operator with the paint being sprayed.

The primary object of the present invention is to provide a reversible spray tip for a spray gun or like device having an axially rotatable transverse cylindrical member with a spray tip arranged in a diametric bore therein which is of simpler construction and thus more easily manufactured than similar prior art spray tips and which is more effective in preventing leakage of the fluid paint. A further object of the present invention is to provide a safe reversible spray tip in that the spray tip guard is an integral part of the spray tip and cannot be removed. A still further object of the present invention is to provide such a reversible spray tip which has a positive snap lock feature to indicate positioning of the transverse cylindrical member in the forward spraying position or in the reverse flow position. Yet another object of the present invention is to provide such a reversible spray tip which can be easily assembled or dismantled without the need for special tools therefor and whose structure facilitates the accurate assembly of the reversible spray tip.

The above objects, as well as others which will hereinafter become apparent, are accomplished in accordance with the present invention by the provision of a reversible spray tip having a cylindrically shaped rotatable turret member with a diametrically transverse fluid bore therein terminating in a spray opening, a housing having a transverse bore for accepting for rotation therein the cylindrically shaped rotatable turret member, and an elongated sealing member disposed between the fluid bore in the rotatable turret member and the fluid discharge end of a spray gun. The housing has integrally formed therewith a V-shaped spray tip guard whose diverging ears extend forward from the spray tip opening. A securing nut, captively and rotatably held on the housing, secures the housing to the fluid discharge end of the spray gun and causes said sealing member to seal against the spray gun fluid discharge end.

The present invention will be described and understood more readily when considered together with the accompanying drawings, in which.

Figure 1:
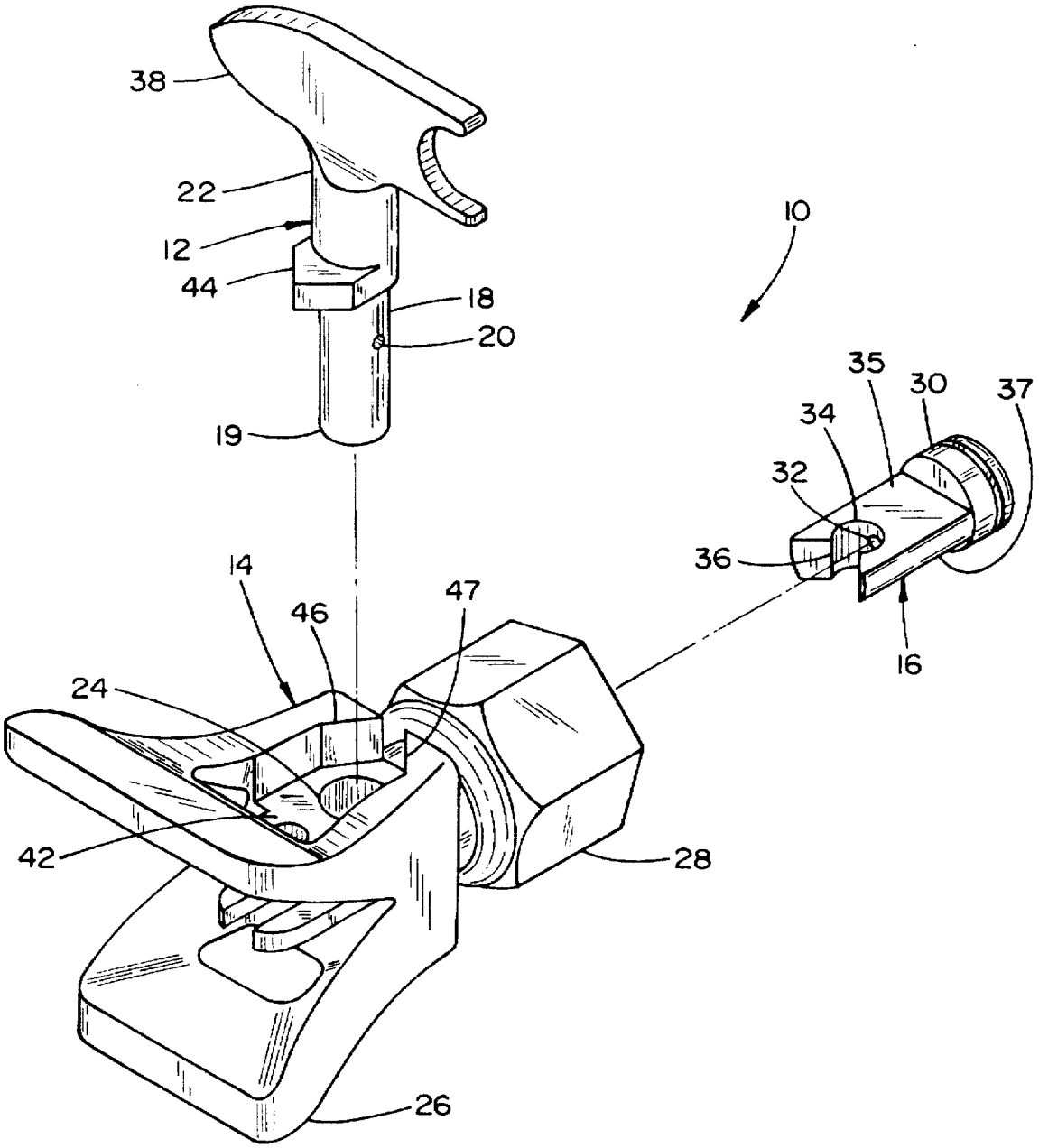
FIG. 1 is an exploded perspective view of the reversible spray tip unit of the present invention.

Referring now to the drawings, there is shown in FIG. 1 a reversible spray tip unit according to the present invention, generally designated 10, for use with a spray gun or like device adapted to hydraulically atomize and spray liquids such as paint. Spray tip unit 10 includes a cylindrically shaped turret member, designated 12, a spray tip housing, designated 14, and a sealing member or seal insert, designated 16.

Cylindrically shaped turret member 12 includes a stem portion 18 having a diametric bore 20 therein and a cap member 22 adapted to be gripped by the user's fingers so as to rotate turret member 12. Housing 14, preferably formed of plastic material, is provided with a transverse bore 24 adapted to accept stem portion 18 of cylindrical turret member 12 therein, a through axial bore (not shown) adapted to accept seal insert 16 therein and Y or V shaped forward extending ears which form tip guard 26. A securing nut, designated 28, rotatably mounted at the rear of housing 14, secures spray tip unit 10 to the forward or discharge end 29 (see FIGS. 7 and 8) of the spray gun. Securing nut 28 cooperates with housing 14 and a flange, designated 30, of seal insert 16 to cause seal insert 16 to seal against the end face of the spray gun. Seal insert 16 is provided with an axial fluid bore 32 which aligns with the fluid bore (not shown) of the spray gun at one end and with bore 20 in stem portion 18 of cylindrical member 12 at the forward end. The forward end of seal insert 16 is provided with transverse bore 34 which has a sidewall opening 36 at the forward end of the insert.

While seal insert 16 is generally cylindrical in shape, it is provided with at least one longitudinal flat 35 which is complimentary to at least one identical flat in the through axial bore (not shown) of housing 14 which accepts seal insert 16 therein. Longitudinal flat 35 and its complimentary flat in the axial bore of housing 14 are so arranged to index seal insert 16 so that bore 34 thereof aligns with traverse bore 24 of housing 14. Thus, when stem portion 18 of turret member 12 is inserted into bore 24 it is accepted without deviation into bore 34 of seal insert 16 thereby facilitating the accurate assembly of reversible spray tip unit 10. In the drawings an additional longitudinal flat, designated 37, is provided on seal insert 16 which mates with a complimentary identical flat in the through axial bore of housing 14 thereby permitting seal insert 16 to be positioned in the axial bore of housing 14 in either of two positions disposed 180° with respect to each other.

Figure 2:
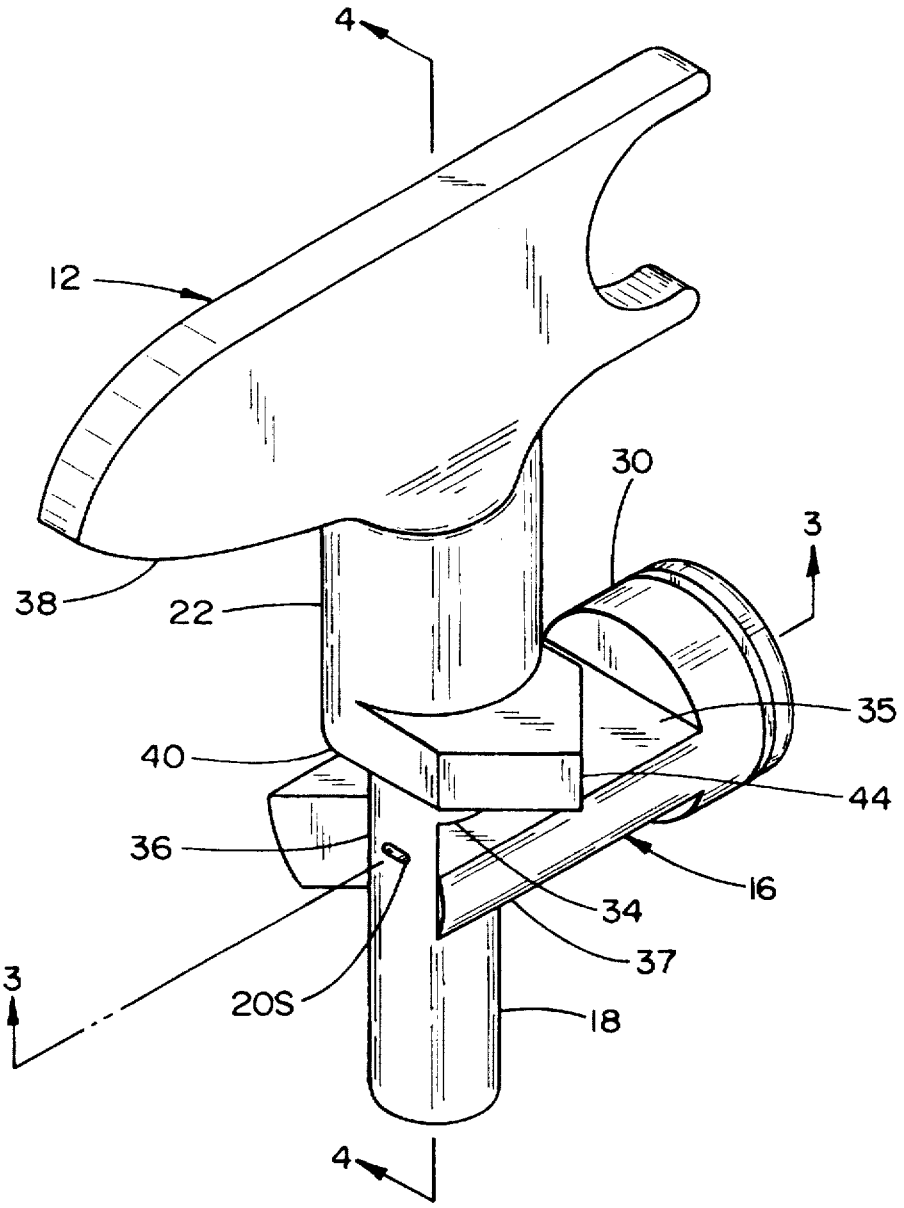
FIG. 2 is a perspective view of the reversible spray tip unit of the present invention shown assembled but without the housing therefor.

As clearly seen in FIG. 2, stem portion 18 of cylindrical turret member 12 is accepted within bore 34 of seal insert 16 with an interference fit since bore 34 has a slightly smaller radius than stem portion 18. Because sidewall opening 36 is less than 180° of bore 34, the interference fit of stem portion 18 in bore 34 holds cylindrical member 12 in the assembled reversible spray tip 10 without the need for other retaining means. The bottom end 19 of stem portion 18 is tapered to facilitate the insertion of stem portion 18 into bore 34 of seal insert 16. Furthermore, since seal insert 16 is formed of a plastic material, the radial force exerted by stem portion 18 against the wall of bore 34 enhances the sealing pressure of seal insert 16 at diametric bore 20 in stem portion 18 and also exerts an axially directed pressure along seal insert 16 to enhance the sealing pressure against the front face of the spray gun. As also clearly shown in FIG. 2, the forward or spray end of bore 20 in stem portion 18, designated 20S, has an elongated oval shape. The significance of this shape of forward end 20S of bore 20 will be described hereinafter in connection with FIG. 9.

Cap member 22 of turret member 12 is fitted onto stem portion 18 such that the flattened arrow portion 38 thereof, which facilitates rotation of turret member 12 by the user, points in the direction of forward or spray end 20S of bore 20. Thus, the user can easily determine whether the spray tip is in the spray position or in the reversed position for clearing a clogged spray opening by the position of arrow 38. The lower extremity of cap member 22 forms a shoulder 40 which, when spray tip 10 is assembled, rests on mating surface 42 of housing 14 such that diametric bore 20 of stem portion 18 is substantially aligned with axial fluid bore 32 of seal insert 16 when turret member 12 is positioned for spraying or reversed for clearing obstructions. Shoulder 40 has, extending radially therefrom, a locking cam element 44 which is substantially triangularly shaped and which cooperates with flat wall faces 46 and 47 which extend upwardly from surface 42 of housing 14 to lock the position of turret member 12 in the spray position or in the reversed position as described hereinafter.

As clearly seen in FIGS. 3 to 6 and 9, a spray tip insert, designated 48, formed of a hard material such as a tungsten carbide to resist erosion from the abrasive material passing through fluid bore 50 thereof, is press-fitted into bore 20 of stem portion 18 of turret member 12. The spray orifice 52 of insert 48 is positioned at forward end 20S of bore 20 and a diffuser pin 54, also formed of tungsten carbide, is arranged diametrically in fluid bore 50 upstream from orifice 52. Diffuser pin 54 ensures that when spray tip 10 is reversed for the purpose of dislodging material clogging spray orifice 52, the high pressure fluid exiting from fluid bore 50 opposite orifice 52 does not do so as a solid stream. A diffuser holder, designated 49, is also press-fitted into bore 20 behind diffuser pin 54 to thereby maintain the pin transversely in bore 20. Preferably, the end of insert 48 opposite orifice 52 is provided with diametrically opposed recesses 51 and 53 in which diffuser pin 54 nests or seats to thereby prevent movement of pin 54 as fluid passes. Diffuser holder 49 is machined to present a flush surface at stem portion 18. The bore 55 of diffuser holder 49 at the surface of stem portion 18 is smaller than bore 32 of seal insert 16 to thereby minimize scoring of the sealing face of seal insert 16 and to allow for slight misalignment of the axes of the bores 32 and 55 and also to avoid sealing problems between the two bores.

Figure 3:
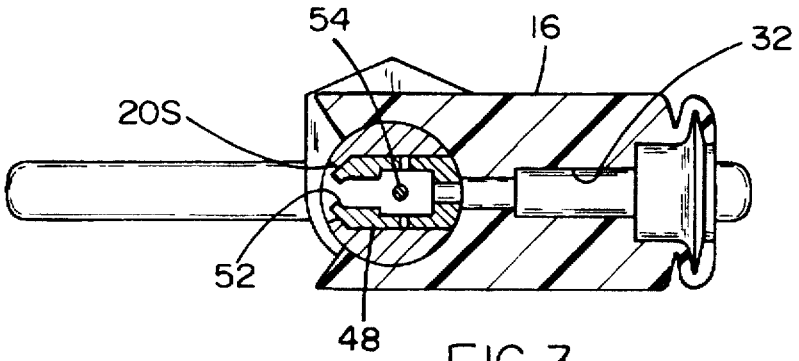
FIG. 3 is a cross-sectional view of the reversible spray tip unit shown in the spraying position taken along line 3—3 of FIG. 2.
Figure 4:
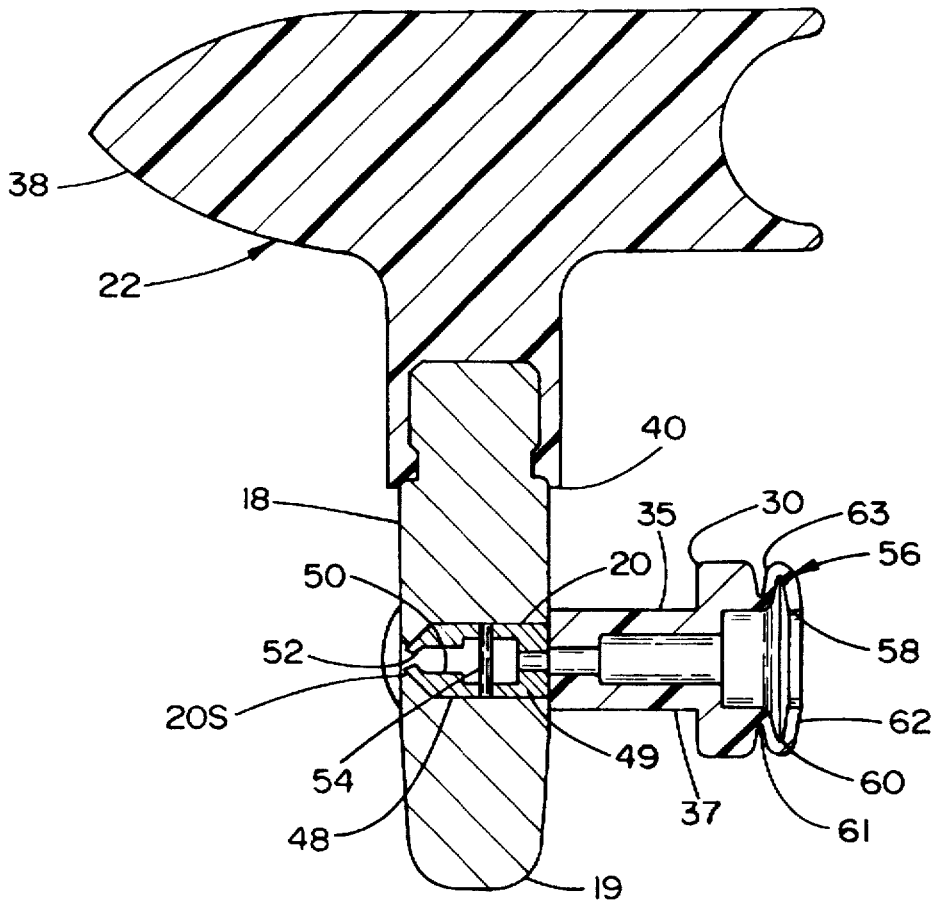
FIG. 4 is a cross-sectional view of the reversible spray tip unit shown in the spraying position taken along line 4—4 of FIG. 2.
Figure 5:
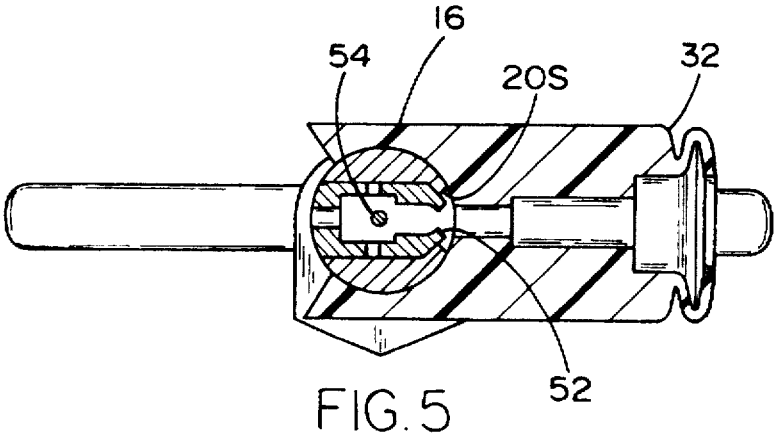
FIG. 5 is a cross-sectional view of the reversible spray tip unit similar to FIG. 3 shown in the reversed position.
Figure 6:
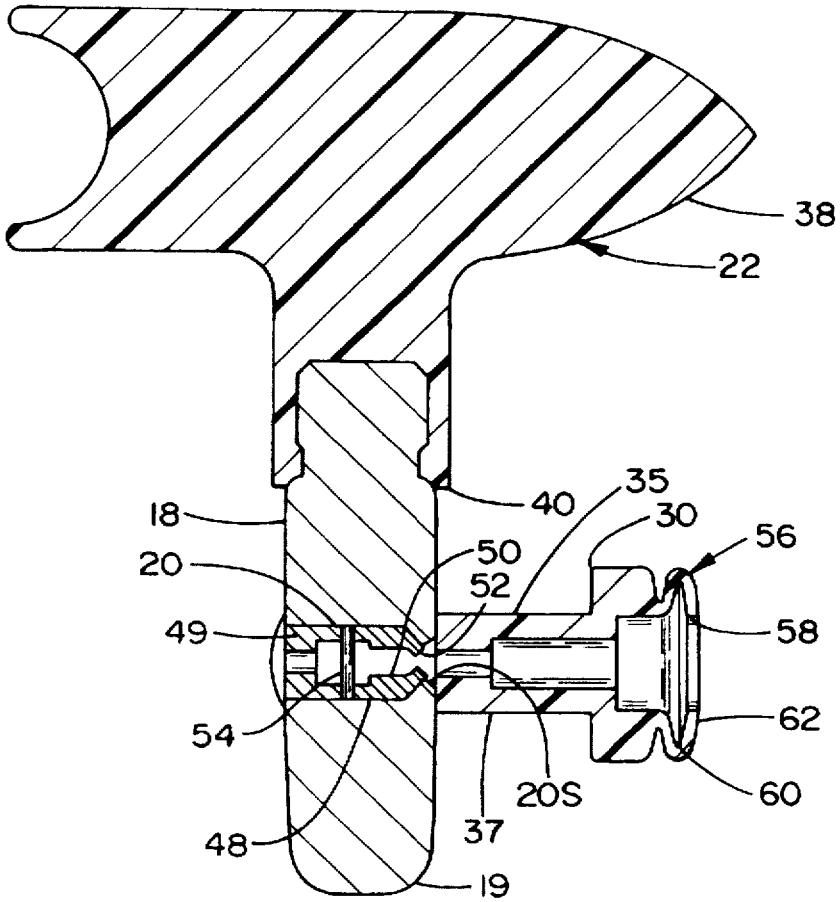
FIG. 6 is a cross-sectional view of the reversible spray tip unit similar to FIG. 4 shown in the reversed position.

FIGS. 3 and 4 show the positioning of turret member 12 with respect to seal insert 16 with spray orifice 52 of spray tip insert 48 facing forwardly so that the high pressure fluid exiting therefrom forms a fan spray suitable for spray painting. FIGS. 5 and 6 show the positioning of turret member 12 with respect to seal insert 16 with spray orifice 52 of spray tip insert 48 facing rearwardly towards fluid bore 32 of seal insert 16. In this latter described position, the high pressure fluid passing through fluid bore 50 of spray tip insert 48 is reversed so that any material clogging spray orifice 52 is dislodged and driven out the larger opening of bore 55 of diffuser holder 49 opposite orifice 52.

Flange 30 of seal inset 16 has axially extending therefrom a flexible seal member or washer 56 which faces the front face of the discharge end 29 of the spray gun to which spray tip unit 10 is attached. Seal member 56 has a fluid orifice 58 which communicates with the fluid passageway of the spray gun and an internal chamber 60 defined by flexible rear wall 62 which circumscribes orifice 58. As high pressure fluid enters chamber 60 of seal member 56, wall 62 thereof expands rearwardly against the front face of the discharge end 29 of the spray gun to create a seal thereat. Simultaneously, the pressure in chamber 60 forces seal insert 16 forwardly to enhance the sealing pressure between seal insert 16 and stem portion 18 of turret member 12. An outer circumferential groove, designated 61, may be formed forwardly of chamber 60 thereby defining a forward flexible wall 63 peripherally joined to rear wall 62. The addition of forward wall 63 creates a bellows-like flexible seal member 56. Seal member 56 so enhances the sealing effectiveness of seal insert 16 during operation of the spray gun, that only finger tightening of securing nut 28 is required to produce a seal. Thus, when the spray gun is not operated and seal member 56 is thus in a relaxed state, the sealing pressure between seal insert 16 and turret member 12 is relieved to such an extent that the turret member 12 can be easily rotated from the spraying position shown in FIGS. 3 and 4 to the reversed clearing position shown in FIGS. 5 and 6 without special tools.

Figure 7:
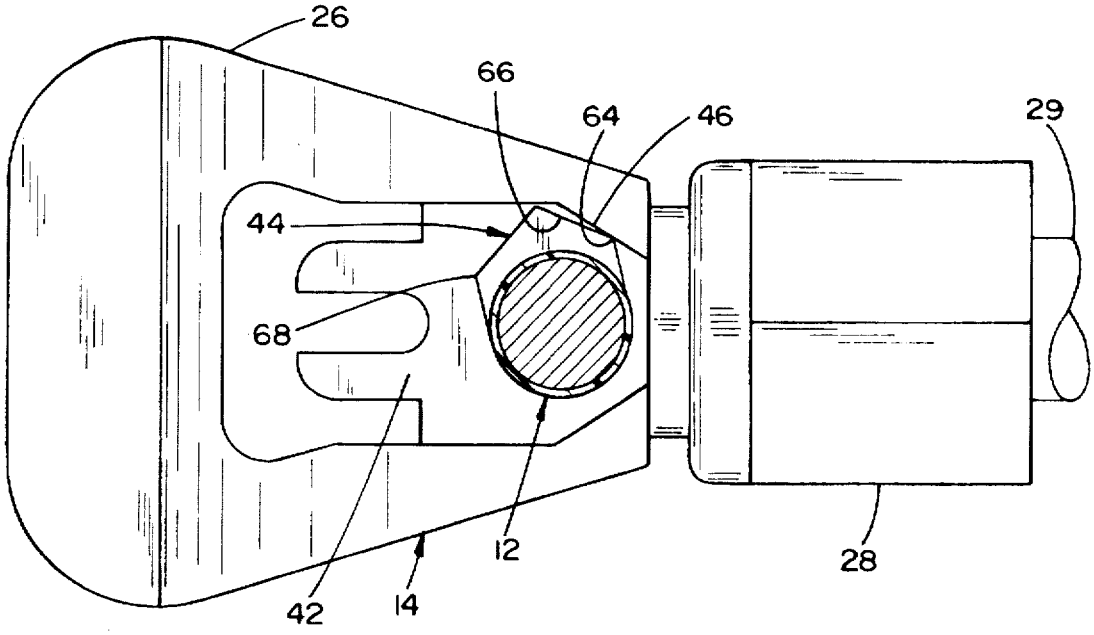
FIGS. 7 and 8 are plan views of the assembled reversible spray tip unit according to the present invention showing the locking feature for the rotatable cylindrical turret member.
Figure 8:
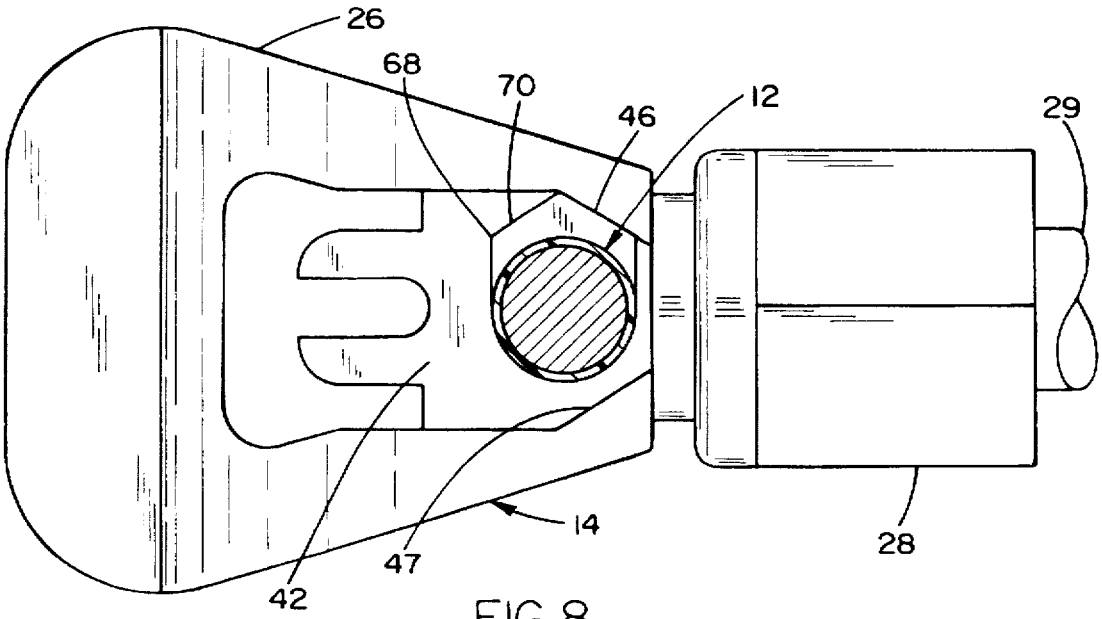

In FIGS. 7 and 8 the operation of locking cam element 44 is shown. Locking cam element 44 includes a first cam lobe 64 and adjoining flat surface 66 which mates with flat wall face 46 of housing 14. When cam lobe 64 passes wall face 46 and surface 66 of locking cam element 44 contacts and meets wall face 46 completing the clockwise rotation of turret member 12, as shown in FIG. 8, turret member 12 is in the reversed position permitting the clearing of the fluid bore of spray tip insert 16. Locking cam element 44 also includes a second cam lobe 68 and adjoining flat surface 70 which is symmetrical with and a mirror image of cam lobe 64 and flat surface 66 and which cooperate with flat wall face 47 of housing 14 to lock-in or fix turret member 12 in the spraying position. Locking cam element 44 cooperating with wall faces 46 and 47 permit a positive locking-in of turret member 12 in the spraying position or the reversed position for cleaning.

Furthermore, the orientation of walls 46 and 47, which are angularly arranged with respect to the longitudinal axis of reversible spray tip unit 10, helps to prevent paint build up thereon which may interefere with the proper operation of locking cam element 44. Paint build up on surfaces of the spray tip unit tends to be most severe on surfaces perpendicular to the longitudinal axis of the unit and least severe on surfaces parallel thereto since the general direction of paint over-spray or bounce back is axial with respect to the spray gun or spray tip unit.

Figure 9:
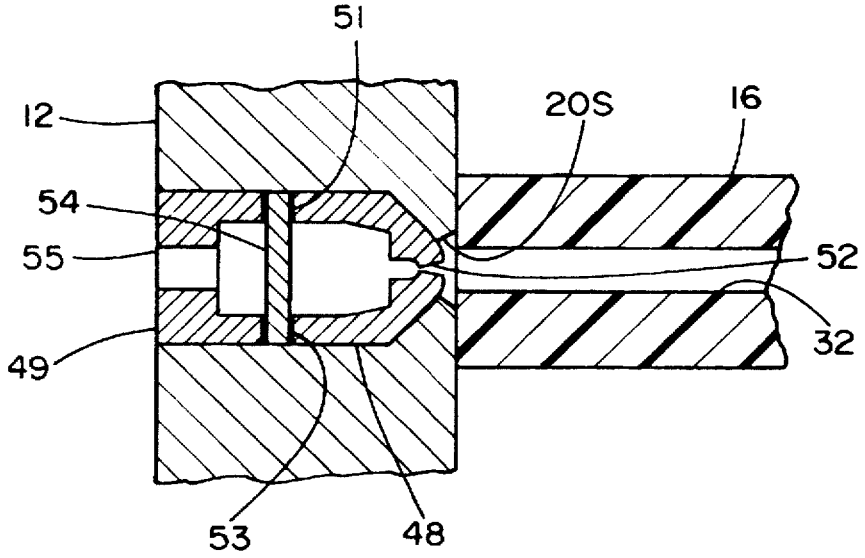
FIG. 9 is an enlargement of a portion of FIG. 6 showing the interface of the seal insert and the rotatable cylindrical turret member of the reversible spray tip unit.

FIG. 9 is an enlarged view of rotatable turret member 12 in the reversed position for cleaning and the seal insert 16 of spray tip 10. As clearly seen therein, spray orifice 52 of spray tip insert 48 is positioned facing the high pressure fluid exiting fluid bore 32 of seal insert 16. As indicated hereinabove, the forward end 20S of bore 20 which receives spray tip insert 48 has an elongated oval shape which is substantially parallel to the conventional elongated slit of spray orifice 52 of spray tip insert 48. It is preferable that the outer edge of end 20S of bore 20 not have a sharp corner in order not to score the plastic material at the face of seal insert 16 during the rotation of turret member 12. Thus, this outer edge can be rounded off during manufacture or machined to have an angle greater than zero degrees to the horizontal. The elongated oval shape of end 20S of bore 20, as opposed to the conventional round shape, exposes less surface area of spray tip insert 48 surrounding spray orifice 52 and turret member 12 to the pressure of the high pressure fluid exiting fluid bore 32 of seal insert 16. As a result of this lower pressure exerted on spray tip insert 48 and turret member 12, less sealing pressure is required between turret member 12 and seal insert 16 to prevent leakage thereat so that over tightening of securing nut 28 is not required and mere finger tightening thereof suffices.

Seal insert 16 is formed of a plastic material which is chemically resistant, solvent resistant and high pressure resistant. Preferably, insert 16 is molded from a blend of NYLON Type 66, available from DuPont under the name ZYTEL 101 NYLON, and ZYTEL 801 NYLON also available from DuPont. Although proportions of these material may be varied as desired, it has been found preferable to blend about 90% of ZYTEL 101 and 10% of ZYTEL 801 for purposes of the present invention.

In order to facilitate the disassembly of reversible spray tip unit 10, it has been found that once turret member 12 has been removed from the unit by extracting stem portion 18 from bore 34 of seal insert 16, the flattened arrow portion 38 of cap member 22 can be advantageously utilized as an extraction tool to remove seal insert 16 from housing 14. Thus, arrow portion 38 can be inserted into the open front of unit 10 to engage the forward end of seal insert 16 at about sidewall opening 36 and, with axial pressure thereon, seal insert 16 can be dislodged from housing 14.

While only a single embodiment of the present invention has been shown and described it will be obvious that many changes and modifications may be made thereunto without departing from the spirit and scope of the present invention.

What is claimed is:

1. A reversible spray tip adapted to be secured to the discharge end of a spray gun for hydraulically atomizing and spraying liquids, said reversible spray tip comprising:

a) a housing having a forward extending spray tip guard integrally formed therewith;

b) a cylindrically shaped rotatable turret member received for rotation in a transverse bore in said housing, said turret member including a diametric bore therethrough;

c) a spray tip insert received in said diametric bore of said turret member, said spray tip insert having a fluid bore therethrough terminating adjacent an end of said diametric bore in a spray orifice;

d) a one piece seal insert received in an axial through bore of said housing upstream of said turret member and extending from said turret member to the spray gun discharge end, said seal insert including a transverse bore therein having a forwardly facing sidewall opening corresponding to the spray orifice of said spray tip insert, said transverse bore having a diameter smaller than the diameter of said cylindrical turret member so as to receive said turret member with an interference fit so as to releasably secure said turret member in said reversible spray tip, said seal insert having an axial fluid bore therein communicating between the spray gun discharge end and the transverse bore of said seal insert diametrically opposite the forward facing sidewall opening and in alignment with said fluid bore of said spray tip insert;

e) means coupled with said seal insert for enhancing the sealing pressure between said seal insert and said turret member and between said seal insert and the spray gun discharge end during spray gun operation; and f) means for securing said housing to the spray gun discharge end.

2. A seal insert for a spray tip, said seal insert having first and second ends, said seal insert comprising:

a bellows-like portion for forming a seal at said first end of said seal insert;

a body portion for aligning said seal insert within a housing; and a semi-cylindrical portion for forming a seal at said second end, said semi-cylindrical portion being arranged to extend more than 180° around a cylindrical turret member (18) and having a diameter smaller than said turret member so as to form an interference fit therewith, said body portion being located between said bellows-like portion and said semi-cylindrical portion.

3. A locking structure for a reversible spray tip including a housing having an opening and a turret member rotatably supported within said opening, said locking structure comprising:

first and second wall surfaces arranged on said housing angularly with respect to a longitudinal axis of said reversible spray tip; and a locking cam element arranged on said turret member for engaging said first and second wall surfaces to releasably lock said turret member in first and second positions thereof.

4. The reversible spray tip as defined in claim 1, which further includes means for indexing said seal insert so that upon insertion into the axial through bore of said housing the seal insert transverse bore aligns with the transverse bore in said housing so that said turret member engages without deviation the said seal insert transverse bore during assembly of said reversible spray tip.

5. The reversible spray tip as defined in claim 4, wherein said indexing means comprises at least one longitudinal flat on said seal insert mateable with a complimentary flat in the axial through bore of said housing.

6. The reversible spray tip as defined in claim 1, wherein said forward extending spray tip guard integrally formed with said housing is substantially Y-shaped with the ears thereof extending forwardly from said housing.

7. The reversible spray tip as defined in claim 1, wherein said housing is formed of plastic material.

8. The reversible spray tip as defined in claim 1, wherein the means for enhancing the sealing pressure between said seal insert and said turret member and between said seal insert and the spray gun discharge end during spray gun operation comprises a bellows-like flexible seal washer integral with and extending from the upstream end of said seal insert between said seal insert and the spray gun discharge end.

9. The reversible spray tip as defined in claim 8, wherein said bellows-like flexible seal washer comprises a pair of circumferential flexible washers peripherally joined to define a flexible chamber therebetween whereby during spray gun operation pressurized fluid enters said chamber and increases the sealing pressure forwardly and rearwardly from said bellows-like flexible seal washer.

10. The reversible spray tip as defined in claim 1, wherein the means for enhancing the sealing pressure between said seal insert and said turret member and between said seal insert and the spray gun discharge end during spray gun operation comprises an internal groove formed in the axial fluid bore of said seal insert proximate the spray gun discharge end and defining a flexible chamber having a flexible rear peripheral wall facing the spray gun discharge end.

11. The reversible spray tip as defined in claim 1, which further comprises means for releasably locking said turret member in the spray position with the spray orifice of the spray tip insert directed forwardly and in the reversed position with the spray orifice of the spray tip insert directed rearwardly toward the fluid bore of said seal insert.

12. The reversible spray tip as defined in claim 11, wherein said releasable locking means includes a locking cam element extending radially from said turret member engageable with complementary wall surfaces on said housing.

13. The reversible spray tip as defined in claim 12, wherein said locking cam element comprises a first radial cam lobe and an adjacent vertical wall surface and a second radial cam lobe and an adjacent vertical wall surface symmetrical with and a mirror image of said first cam lobe and adjacent wall surface.

14. The reversible spray tip as defined in claim 13, wherein said complementary wall surfaces on said housing comprise a first vertical wall surface mating with the vertical wall surface adjacent the first cam lobe to position the turret member for reverse fluid flow in the fluid bore of the spray tip insert, and a second vertical wall surface mating with the vertical wall surface adjacent the second cam lobe to position the turret member for spraying.

15. The reversible spray tip as defined in claim 1, wherein the spray orifice of said spray tip insert has a conventional elongated slit shape and the end of said diametric bore in said turret member adjacent to said spray orifice has a shape substantially parallel to the shape of said spray orifice.

16. The reversible spray tip as defined in claim 15, wherein the end of said diametric bore in said turret member adjacent to said spray orifice has an outer edge which is rounded-off.

17. The reversible spray tip as defined in claim 15, wherein the end of said diametric bore in said turret member adjacent to said spray orifice has an outer edge having an angle to the horizontal greater than zero degrees.

18. The reversible spray tip as defined in claim 15, wherein the end of said diametric bore in said turret member adjacent to said spray orifice has an elongated oval shape.

19. The reversible spray tip as defined in claim 1, which further includes a diffuser pin arranged transversely in said diametric bore of said turret member upstream from said spray tip insert and means for retaining said diffuser pin in said diametric bore.

20. The reversible spray tip as defined in claim 19, wherein the retaining means comprises a diffuser holder press-fitted into said diametric bore of said turret member upstream from said diffuser pin.

21. The reversible spray tip as defined in claim 20, wherein said spray tip insert has diametrically opposed recesses at an end thereof opposite said spray orifice for seating said diffuser pin.

22. The reversible spray tip as defined in claim 1, wherein said seal insert is formed of a material molded from a blend of NYLON TYPE 66 and ZYTEL 801 NYLON.

23. The reversible spray tip as defined in claim 22, wherein the proportion of said materials are 90% NYLON TYPE 66 and 10% ZYTEL 801 NYLON.

24. A turret member for a reversible spray tip, said turret member comprising:

a cylindrical portion with a cylindrical surface;

a transverse through passageway extending through said cylindrical portion, said through passageway defining an elongated non-circular opening intersecting said cylindrical surface of said cylindrical portion; and an orifice element located within said transverse through passageway and aligned with said opening.

25. The turret member as defined in claim 24, further comprising means for retaining said orifice element (48) within said through passageway (20).

26. The turret member as defined in claim 25, wherein said opening 20S is generally oval.

27. The turret member as defined in claim 26, wherein said orifice element is formed of tungsten carbide.

* * * * *